US006338788B1

(12) United States Patent
Schucker

(10) Patent No.: US 6,338,788 B1
(45) Date of Patent: Jan. 15, 2002

(54) ELECTROCHEMICAL OXIDATION OF SULFUR COMPOUNDS IN NAPHTHA

(75) Inventor: Robert Charles Schucker, Woodlands, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/537,194

(22) Filed: Mar. 28, 2000

Related U.S. Application Data

(60) Provisional application No. 60/138,688, filed on Jun. 11, 1999.

(51) Int. Cl.[7] ..... C25B 1/00
(52) U.S. Cl. ..... 205/688; 205/695; 205/696
(58) Field of Search ..... 205/688, 695, 205/696

(56) References Cited

U.S. PATENT DOCUMENTS

| | | | | |
|---|---|---|---|---|
| 2,140,194 A | | 12/1938 | Yabroff et al. | 204/9 |
| 2,654,706 A | | 10/1953 | Gaylor et al. | 204/153 |
| 2,856,353 A | | 10/1958 | Miller | 208/235 |
| 3,193,484 A | | 7/1965 | Gleim | 204/79 |
| 3,309,413 A | | 3/1967 | Ferrara et al. | 260/674 |
| 3,915,819 A | * | 10/1975 | Bell et al. | 204/136 |
| 5,527,434 A | | 6/1996 | Hamnett et al. | 205/337 |
| 5,723,039 A | | 3/1998 | Zosimov et al. | 205/696 |

FOREIGN PATENT DOCUMENTS

| | | |
|---|---|---|
| CA | 836556 | 3/1970 |
| PL | 119155 | 11/1979 |
| WO | WO93/25636 | 12/1993 |

OTHER PUBLICATIONS

Marken, F.; R. G. Compton; S. D. Bull; S. G. Davies; "Ultrsound–Assisted Electrochemical Reduction of Emulsions in Aqueous Media", Chem. Comm., 1997, 995–996. No Month.

Seymour, J. D.; R. B. Gupta; "Oxidation of Aqueous Pollutants Using Ultrasound: Salt Induced Enhancement", Ind. Eng. Chem. Res., 1997, 36, 3453–3457. No Month.

Marken, F.; R. G. Compton; S. G. Davies; S. D. Bull; T. Thiemann; M. L. Sa e Melo; A. C. Neves; J. Castill; C. G. Jung and A. Fontana; "Electrolysis in the Presence of Ultrasound: Cell Geometries for the Application of Extreme Rates of Mass Transfer in Electrolysis", J. Chem. Soc.; Perking trans., 1997, 2, 2055–2059. No Month.

Hourani, M.; "Desulfurization of Thiophene by Electrochemical Perturbation", J. Electroanal. Chem, 1994, 368(1–2), 139–142. No Month.

Aeiyach, Salah; Bazzaoui, E. Arbi; Lacaze, Pierre–Camille; "Electropolymerization of Thiophene on Oxidizable Metals in Organic Media", J. Electroanal. Chem., 1997, 434(1–2), 153–162. No Month.

(List continued on next page.)

*Primary Examiner*—Arun S. Phasge
(74) *Attorney, Agent, or Firm*—Estelle C. Bakun; Gerard J. Hughes

(57) ABSTRACT

An embodiment of the invention is directed to an electrochemical process for removing polymerizable sulfur compounds from a hydrocarbon feed by (a) combining a solvent and electrolyte with a feed comprising hydrocarbon and polymerizable sulfur compounds to form a first mixture; (b) passing said first mixture into an electrochemical reactor to electrochemically oxidize said polymerizable sulfur compounds in said mixture under conditions capable of producing sulfur oligomers from said polymerizable sulfur compounds; (c) separating said oxidized first mixture to obtain a desulfurized hydrocarbon feed, and a second mixture comprising sulfur oligomers, solvent and electrolyte.

13 Claims, 2 Drawing Sheets

OTHER PUBLICATIONS

Schrebler, R.; Grez, P.; Cury, P.; Veas, C.; Merino, M.; Gomez, H.; Cordova, R.; del Valle, M.A.; "Nucleation and Growth Mechanisms of Poly(thiophene). Part 1. Effect of Electrolyte and Monomer Concentration in Dichloromethane", J. Electroanal. Chem., 1997, 430(1–2), 77–90. No Month.

Roncali, J., "Conjugated Poly(thiophenes): Synthesis, Functionalization and Applications", Chem. Rev., 92, 711–738, 1992.

Wei, Y., Chan C., Tian J., Jang G, and Hsueh, K. F., "Electrochemical Polymerization of Thiophenes in the Presence of Bithiophene or Terthiophene: Kinetics and Mechanism of Polymerization", Chem. Mater., 3, 888–897, 1991.

* cited by examiner

ELECTROCHEMICAL OXIDATION OF SULFUR COMPOUNDS IN NAPHTHA

This application claims the benefit of U.S. Provisional Application No. 60/138,688 Jun. 11, 1999.

FIELD OF THE INVENTION

An embodiment of the invention is directed to an electrochemical method for removing sulfur from a hydrocarbon stream, preferably a naphtha feedstream while preserving octane number.

BACKGROUND OF THE INVENTION

Due to environmental regulations the amount of sulfur present in gasoline streams must be closely controlled. Gasoline is typically made up of a mixture of (1) naphthas from fluid catalytic cracking processes, (2) reformate from catalytic reforming processes, (3) alkylate from acid-catalyzed alkylation processes and (4) various additives. Almost all of the sulfur in gasoline is contributed by the naphtha component. The regulations will require the amount of sulfur in gasoline to be reduced to about 150 ppm by the year 2000, with further reduction to about 30 ppm by the year 2004. Thus, there is a critical need for technologies that are capable of lowering the amount of sulfur present in naphtha streams.

Present technology for lowering the amount of sulfur in naphtha streams, which is based on catalytic hydrotreating, results in an octane loss due to saturation of olefins present in the naphthas. Thus, following the sulfur removal, octane must be replaced. In the Mobil Oct-Gain and Intevep ISAL processes, for instance, the desulfurized product is isomerized, resulting in an increase in octane but at a substantial yield loss.

SUMMARY OF THE INVENTION

An embodiment of the invention is directed to an electrochemical process for removing polymerizable sulfur compounds from a hydrocarbon feed comprising the steps of:

(a) combining a solvent and electrolyte with a feed comprising hydrocarbon and polymerizable sulfur compounds to form a first mixture;

(b) passing said first mixture into an electrochemical reactor to electro-chemically oxidize said polymerizable sulfur compounds in said mixture under conditions capable of producing sulfur oligomers from said polymerizable sulfur compounds;

(c) separating said oxidized first mixture and recovering a desulfurized hydrocarbon feed, and a second mixture comprising sulfur oligomers, solvent and electrolyte.

An embodiment of the invention may further comprise step (d) recycling said second mixture to said step (a).

An embodiment of the invention may optionally comprise (d) separating said sulfur oligomers from said second mixture to recover a stream comprising solvent and electrolyte; and (e) recycling said stream comprising solvent and electrolyte to said step (a).

Figure 1:
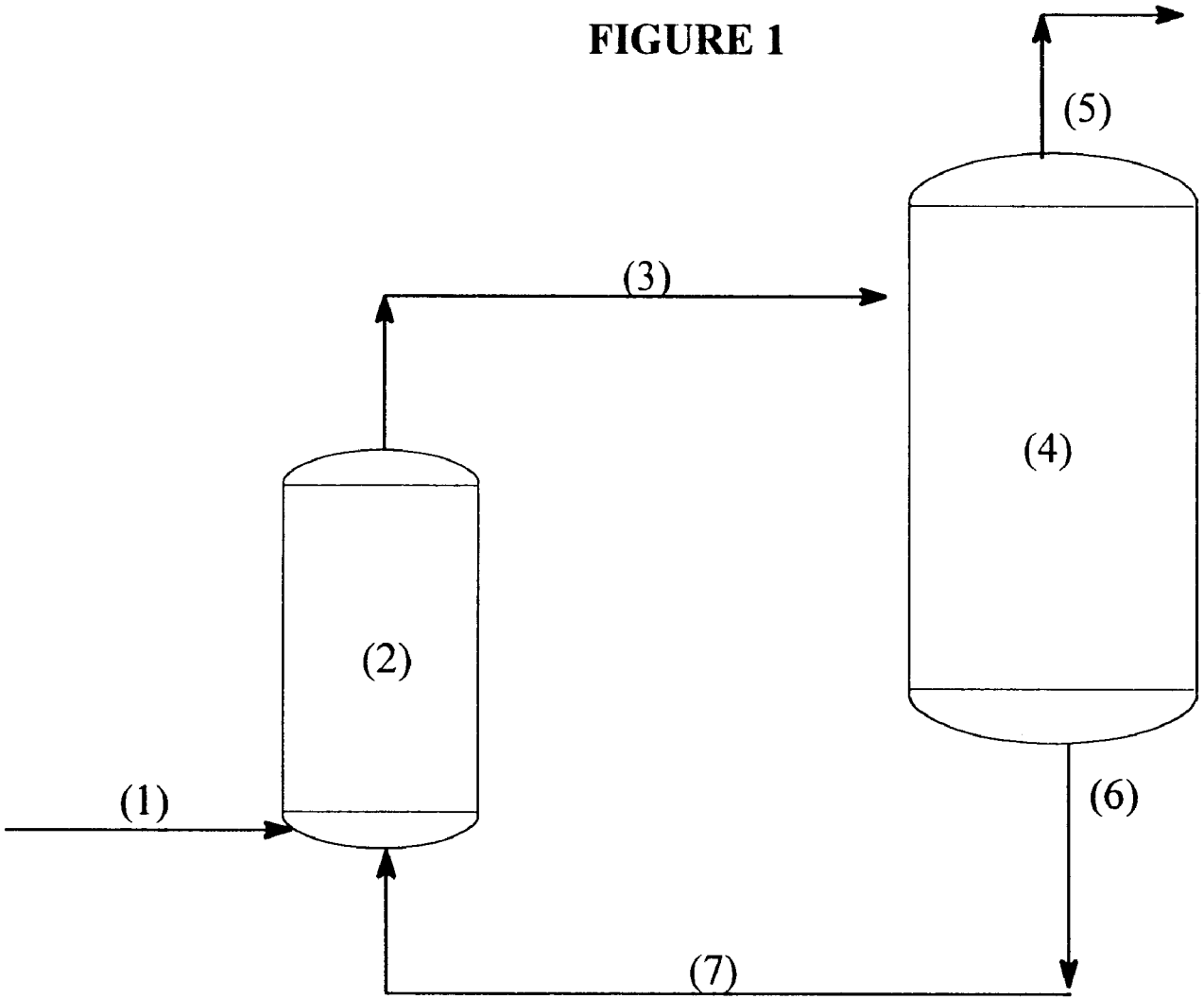
FIG. 1 depicts one possible configuration of an embodiment of the invention.

A mixture (1) comprising hydrocarbon feed containing sulfur of compounds, solvent and electrolyte is passed to an electrochemical reactor (2) where sulfur oligomers are formed. The products from the electrochemical reactor (3) (comprising hydrocarbon feed, sulfur oligomers, solvent, and electrolyte) are then passed to a separator (4) where the hydrocarbon is separated and recovered as a desulfurized product (5). The remaining products (6) comprising the remaining sulfur oligomers, solvent, and electrolyte are also recovered and may be recycled back (7) to be combined with the mixture entering the electrochemical reactor. Alternatively, the sulfur oligomers may be separated from the solvent and electrolyte and only the solvent and electrolyte recycled back.

Figure 2:
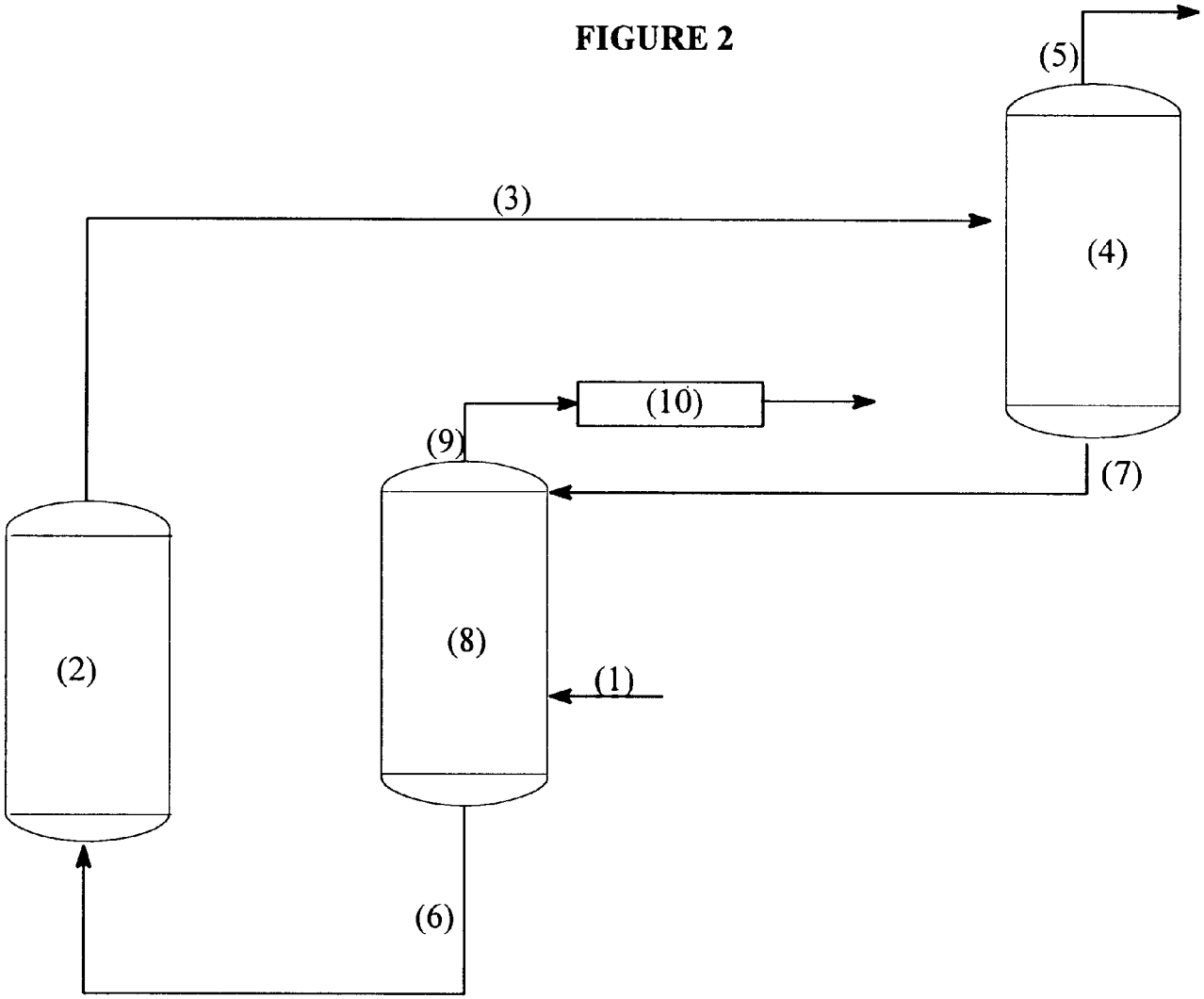
FIG. 2 depicts an alternative process which is a combination of extractive distillation and electrochemical oxidation.

FIG. 2 depicts an alternative process which is a combination of extractive distillation and electrochemical oxidation and which is especially useful for treating mixed LCN/ICN streams. In this scheme, prior to the electrochemical oxidation, hydrocarbon feed containing sulfur compounds (1) is distilled in the presence of solvent and electrolyte in an extractive distillation column (8). Depending on the solvent, the solvent to feed ratio and the temperature, this may be a one-phase or two-phase system. Use of a solvent in this manner results in an effective increase in the boiling point of aromatic sulfur components, which remain with the tower bottoms. The lighter hydrocarbons, which are reduced in aromatic sulfur, can then be recovered from the top of the column (9). The recovered lighter hydrocarbons can then be treated for removal of any remaining sulfur, for example mercaptans in a unit such as a Merox® unit (10). The bottoms from the extractive distillation (6) then pass to the electrochemical reactor (2) where the polymerizable sulfur compounds are oxidized to sulfur oligomers. The products from the electrochemical reactor (3) (comprising hydrocarbon feed, sulfur oligomers, solvent, and electrolyte) are then passed to a separator (4) where the hydrocarbon is separated and recovered as a desulfurized product (5). The remaining products (7) comprising the remaining sulfur oligomers, solvent, and electrolyte are also recovered and may be recycled back to the extractive distillation tower. Alternatively, the sulfur oligomers may be separated from the solvent and electrolyte and only the solvent and electrolyte recycled back.

DETAILED DESCRIPTION OF THE INVENTION

An embodiment of the invention describes a process for oxidatively coupling the polymerizable sulfur compounds contained in hydrocarbon feeds such as naphtha feeds. By oxidatively coupling the sulfur compounds, thereby forming sulfur oligomers, the boiling point of the coupled compounds is increased allowing the hydrocarbon to be separated therefrom by a technique such as distillation. Typically, the polymerizable sulfur compounds are thiophenes, alkylthiophenes, benzothiophenes, alkylbenzothiophenes, and mixtures thereof.

Most of the non-mercaptan sulfur contained in naphthas is in the form of thiophenes and benzothiophenes. The lowest boiling is thiophene (84° C.). Bithiophene, a dimer of thiophene, boils at 265° C. Applicants believe that in the presence of the electrolyte and solvent, the oxidation forms bithiophenes and higher oligomers from thiophene, allowing the desired hydrocarbons to be easily separated by, for example, distillation due to the increase in boiling point of the oligomerized sulfur compounds which fall outside of the naphtha boiling range. In addition, since much of the nitrogen in naphthas is in the form of anilines, the majority of nitrogen compounds should likewise be lowered through the formation of aniline oligomers.

An embodiment of the process affords several advantages. Firstly, extraction yields and selectivities for sulfur compounds do not change with use of an electrolyte in conjunction with solvent. Secondly, there is no need for emulsion formation, surfactants, static mixers and high flow rates. Thirdly, a less expensive undivided cell may be used. Fourth, since dimerization is a one electron reaction (per sulfur monomer unit), total power consumption is very low. Fifth, no undesirable side reaction products such as mixed oxygen/hydrogen streams, are produced, thus eliminating the explosive hazards typically associated with mixed gas systems.

Thus, an embodiment of the invention affords an economical and safe way to remove polymerizable sulfur compounds from hydrocarbon feeds such as naphthas.

As FIG. 2 clearly shows, an embodiment of the invention can utilize a solvent extraction process prior to the electrochemical reaction. This process is particularly useful for streams comprising sulfur compounds and hydrocarbon fractions which are readily separable. For example, a case where the hydrocarbons are a mixture of light cat naphtha (LCN) and intermediate cat naphtha (ICN). In this case, the LCN/ICN enters the extractive distillation column where the LCN is stripped of some sulfur compounds by solvent/electrolyte which is fed to the top of the column. Because the solvent/electrolyte is higher boiling, it proceeds down the column countercurrent to the LCN. Stripped LCN goes overhead. In the LCN boiling range, sulfur is entirely in the mercaptan and sulfide form and is easily removable by technologies such as Merox® treating. The remaining sulfur molecules (aromatic sulfurs) can then be removed by the electrochemical process described herein. The solvent and electrolyte utilized in the extractive distillation will then be utilized as the solvent/electrolyte in the electrochemical reactor.

The solvents utilized herein are any solvent not adversely affected by the voltage range being utilized in the electrochemical cell. Typically, solvents which will complex with aromatics will be utilized. This is evident since the sulfur compounds present in naphthas are primarily aromatic compounds.

Additionally, the solvent should be readily separated or distilled from the desulfurized hydrocarbon product desired. For example, the solvent chosen should have a boiling point which enables ready separation during the distillation process from the desulfurized product being sought. One skilled in the art can readily select appropriate solvents. Non-limiting examples of suitable solvents are ethylene carbonate, propylene carbonate, nitrobenzene, benzonitrile, sulfolane, N-formyl morpholine and mixtures thereof. Typically, any solvent boiling above about 175° C. can be utilized provided that it does not degrade during the electrochemical treatment.

Since the above solvents are not typically conductive by themselves, an electrolyte must also be present in the solvent. Suitable electrolytes are those that will not be adversely affected by the oxidation conducted in the electrochemical cell and which are soluble to a concentration of at least about 0.05 molar in the organic solvent of choice. Again, such electrolytes are readily selectable by the skilled artisan. Non-limiting examples of suitable electrolytes include tetraalkylammonium salts, such as tetraethylammonium perchlorate, tetrabutylammonium perchlorate, tetraethyl ammonium tetrafluoroborate, tetrabutylammonium tetrafluoroborate, tetraethylammonium hexafluorophosphate, tetrabutylammonium hexafluorophosphate, tetraethylammonium paratoluene sulfonate, tetrabutylammonium chloride, tetrabutylammonium bromide and mixtures thereof. Preferably, both the solvents and electrolytes will be non-aqueous. The oxidation conducted in the electrochemical cell is conducted at potentials of about 1.0 to about 2.5 V vs. a Ag/AgCl reference electrode, and current of densities of about 1 to about 10 $mA/cm^2$. It is important that the sulfur compounds not be over-oxidized since the over-oxidized compounds are not conductive. The skilled artisan can easily perform routine experiments using cyclic voltammetry to determine the proper potential of the cell and the correct operating parameters to be used.

Typically the operating temperature for the electrochemical reactor is not critical and will be that which is compatible with the rest of the system. One skilled in the art will recognize that compatibility takes into consideration the temperatures of the entering feed streams and exiting products and the further processing conditions if any. Thus, the temperature can be selected such that entering feed streams do not require heating or cooling and exiting product likewise will not require any heating or cooling. Preferably, temperatures will range from about 25–150° C., more preferably, about 25° C. to about 100° C. Typically, the temperature selected will be below the temperature at which the solvent volatilizes. Pressures utilized will be commensurate with the operating temperature and expected vapor pressure in the electrochemical reactor. Typically, pressures of 0 to about 50 psig will be used. Preferably, the pressure will be about 0 to about 25 psig.

The electrochemical reaction will be conducted at a flow rate and for a time sufficient to allow the sulfur compounds being removed to polymerize.

Such times and flow rates are readily determinable by the skilled artisan. For example, a suitable cell productivity might be defined as the feed flow ratio in barrels per hour to the surface area of the anode in $m^2$ ($BBL/hr/m^2$) and would typically be in the range of about 0.01 to 10 $BBL/hr/m^2$, preferably about 0.05 to about 5.0 and most preferably about 0.1 to about 5.0 $BBL/hr/m^2$.

Both temperatures and pressures can be easily determined by the skilled artisan.

The cells which can be utilized in the embodiment of the invention are any electrochemical cells which are capable of oxidizing sulfur compounds. For example, FM21 cells commercially available from ICI can be utilized.

The type of electrodes which can be utilized in the electrochemical cells are easily selected by the skilled artisan. A high anode to cathode surface area ratio of >50 is preferable. Suitable, non-limiting examples of electrodes include platinum, stainless steel or graphite for the cathode and platinum, stainless steel, nickel, or graphite for the anode. High surface area anodes (such as graphite felt or wire mesh) are preferred.

One further advantage of the embodiment of the invention is that, as the sulfur oligomers are recycled back to be combined with the hydrocarbon feed, they undergo further oxidation and increase in size. This allows them to be polymerized onto the anode in the electrochemical cell. Thus, the sulfur polymers can easily be removed along with the anode which can easily be replaced with a new anode cartridge and the used anode disposed of.

Thus, in the embodiment of the invention, a hydrocarbon feed containing sulfur compounds is mixed with a suitable solvent containing an electrolyte. The resulting mixture, which may or may not be homogeneous, is then passed to an electrochemical cell where selective oxidation of the sulflur compounds occurs. The sulfur compounds are oxidatively oligomerized and either plate out onto the anode or remain in the solvent. The products of the electrochemical reactor are then separated to recover a desulfurized hydrocarbon stream and a mixture of sulfur oligomers (that did not plate out on the anode), solvent, and electrolyte. The solvent, oligomers, and electrolyte can be recycled to assist in the removal of sulfur compounds from fresh hydrocarbons containing Preferably, the hydrocarbon will be separated and recovered from the electrochemical reactor product mixture by distillation. Such technique is preferred since the boiling point of the hydrocarbon allows it to be easily distilled off from the remaining contents of the electrochemical reactor. However, other separation techniques can also be utilized. For example, if the solvent has a high melting point, the mixture can be chilled, and the solvent/electrolyte recovered by decantation of the hydrocarbon stream from it or by filtration. The skilled artisan will readily recognize other separation techniques.

Typically, the hydrocarbon streams which can be treated to remove polymerizable sulfur compounds in accordance with the embodiment of the invention are any streams boiling up to about 450° F. Particularly, naphtha streams will be desulfurized utilizing the process.

An embodiment of the invention may also include a pretreatment step whereby the first mixture is initially passed through an extractive distillation column which allows for light hydrocarbons to be distilled off and recovered. The remaining mixture post recovery of the light hydrocarbons is then passed to the electrochemical reactor. This process is especially beneficial for hydrocarbon feed containing fractions which are readily separable by extractive distillation. For example, feeds containing both light and intermediate cat naphtha. The extractive distillation removes the aromatic sulfur species from the light cat naphtha which is distilled overhead. The sulfur species which remain in the overhead are easily removed by techniques such as Merox® treating. The remaining mixture, containing predominantly aromatic sulfur species, is then treated in the electrochemical cell as described above.

The following examples are illustrative of the embodiment of the invention and are not meant to be limiting in any way.

Example 1

To a 500 ml round bottom flask were added 144.8 grams of N-formylmorpholine, 5.81 grams tetra-n-butyl ammonium hexafluorophosphate ($TBAPF_6$) and 75.01 grams of light cat naphtha having a boiling range from 170–365° F. The mixture was heated to 57° C. and circulated through a parallel plate electrochemical cell (FM-01 manufactured by ICI). The anode and cathode were both stainless steel and the electrode gap was approximately 2 mm. A Teflon® turbulence promoter was used to enhance mass transfer. The power to the cell was turned on and the voltage was adjusted to 5.6 V (DC) using variable power supply. The feed was circulated through the cell for 4 hours and then the power was turned off. Average current during the run was 64.9 mA and a total of 934 Coulombs were passed during the reaction.

A homogenized sample of total product including solvent and electrolyte (2.6498 grams in size) was removed for analysis. To that sample was added 1.0 ml of an internal standard solution comprising 752 micrograms sulfur (as diphenylsulfide) in n-pentadecane. The entire amount was then diluted with ~25 grams of acetone and analyzed on a Hewlett Packard gas chromatograph equipped with a Sievers sulfur chemiluminescence detector. The amounts of individual sulfur compounds as well as the total sulfur were measured. These results showed that 25.3% of the thiophene, 21.4% of the 2-methylthiophene, 25.1% of the 3-methylethiophene, 3.5% of the benzothiophene and 25.9% of the itotal sulfur was removed from the naphtha range by electrochemical oligomerization. A thin black film weighing ~0.0422 gram was removed from the anode. The cathode was clean.

Example 2

To a 500 ml round bottom flask were added 144.68 grams of N-formylmorpholine, 5.81 grams tetra-n-butyl ammonium hexaflourophosphate ($TBAPF_6$) and 50.50 grams of light cat naphtha having a boiling range from 170–365° F. The mixture was heated to 85° C. and circulated through the same cell configuration described in Example 1. The power to the cell was turned on and the voltage was adjusted to 5.6 V(DC) using a variable power supply. The feed was circulated through the cell for 4 hours and then the power was turned off. Average current during the reaction.

A homogenized sample of total liquid product including solvent and electrolyte (1.6826 grams in size) was removed for analysis. To that sample was added 1.0 ml of an internal standard solution comprising 752 micrograms sulfur (as diphenylsulfide) in n-pentadecane. The entire amount was then diluted with ~25 grams of acetone and analyzed on a Hewlett Packard gas chromatograph equipped with a Sievers sulfur chemiluminescence detector. The amounts of individual sulfur compounds as well as the total sulfur were measured. These results showed that 33.2% of the thiophene, 27.3% of the 2-methylthiophene, 27.8% of the 3-methylethiophene, 35.4% of the benzothiophene and 41.7% of the total sulfur was removed from the naphtha range by electrochemical oligomerization.

Example 3

To a 500 ml round bottom flask were added 144.91 grams of Nformylmorpholine, 5.81 grams tetra-n-butyl ammonium hexafluorophosphate ($TBAPF_6$) and 50.61 grams of a light cat naphtha having a boiling range from 170–365° F. The mixture was heated to 98° C. and circulated through the same cell configuration described in Example 1. The power to the cell was turned on and the voltage was adjusted to 5.6 V(DC) using a variable power supply. The feed was circulated through the cell for 4 hours and then the power was turned off. Average current during the run was 88.3 mA and a total of 1272 Coulombs were passed during the reaction.

A homogenized sample of liquid product including solvent and electrolyte (1.9646 grams in size) was removed for analysis. To that sample was added 1.0 ml of an internal standard solution comprising 752 micrograms sulfur (as diphenylsulfide) in n-pentadecane. The entire amount was then diluted with ~25 grams of acetone and analyzed on a Hewlett Packard gas chromatograph equipped with a Sievers sulfur chemiluminescence detector. The amounts of individual sulfur compounds as well as the total sulfur were measured. These results showed that 36.9% of the thiophene, 30.1% of the 2-methylthiophene, 23.2% of the 3-methylethiophene, 24.7% of the benzothiophene and 33.8% of the total sulfur was removed from the naphtha range by electrochemical oligomerization.

Example 4

To a 500 ml round bottom flask were added 144.52 grams of Nformylmorpholine, 5.81 grams tetra-n-butyl ammonium hexafluorophosate ($TBAPF_6$) and 50.16 grams of a light cat naphtha having a boiling range from 170–365° F. The mixture was heated to 85° C. and circulated through the same cell configuration described in Example 1. The power to the cell was turned on and the voltage was adjusted to 5.6 V(DC) using a variable power supply. The feed was circulated through the cell for 4 hours and then the power was turned off. Average current during the run was 103.3 mA and a total of 1487 Coulombs were passed during the reaction.

A homogenized sample total liquid product including solvent and electrolyte (2.0077 grams in size) was removed for analysis. To that sample was added 1.0 ml of an internal standard solution comprising 752 micrograms sulfur (as diphenylsulfide) in n-pentadecane. The entire amount was the diluted with ~25 grams of acetone and analyzed on a Hewlett Packard gas chromatograph equipped with a Sievers sulfur chemiluminescence detector. The amounts of individual sulfur compounds as well as the total sulfur were measured. These results showed that 32.5% of the thiophene, 30.3% of the 2-methylthiophene, 33.5% of the 3-methylethiophene, 26.7% of the benzothiophene and 38.6% of the total sulfur was removed from the naphtha range by electrochemical oligomerization.

Example 5

To a 500 ml round bottom flask were added 144.60 grams of Nformylmorpholine, 5.81 grams tetra-n-butyl ammonium hexafluorophosphate ($TBAPF_6$) and 25.2 grams of a light cat naphtha having a boiling range from 170–365° F. The mixture was heated to 85° C. and circulated through the same cell configuration described in Example 1. The power to the cell was turned on and the voltage was adjusted to 5.6 V(DC) using a variable power supply. The feed was circulated through the cell for 6 hours and then the power was turned off. Average current during the run was 97.9 mA and a total of 2114 Coulombs were passed during the reaction.

A homogenized sample of total liquid product including solvent and electrolyte (0.9496 grams in size) was removed for analysis. To that sample was added 1.0 ml of an internal standard solution comprising 752 micrograms sulfur (as diphenylsufide) in n-pentadecane. The entire amount was then diluted with ~25 grams of acetone and analyzed on a Hewlett Packard gas chromatograph equipped with a Sievers sulfur chemuluminescence detector. The amounts of individual sulfur compounds as well as the total sulfur were measured. The results showed that 24.1% of the thiophene, 24.5% of the 2-methylthiophene, 16.6% of the 3-methylethiphene, 65.1% of the benzothiophene and 58.7% of the total sulfur was removed from the naphtha range by electrochemical oligomerization.

Example 6

To a 500 ml round bottom flask were added 144.83 grams of Nformylmorpholine, 5.81 grams tetra-n-butyl ammonium hexafluorophosphate ($TBAPF_6$) and 25.71 grams of a light cat naphtha having a boiling range from 170–365° F. The mixture was heated to 57° C. and circulated through the same cell configuration described in Example 1. The power to the cell was turned on and the voltage was adjusted to 5.8 V(DC) using a variable power supply. The feed was circulated through the cell for 6 hours and then the power was turned off. Average current during the run was 101.7 mA and a total of 2196 Coulombs were passed during the reaction.

A homogenized sample of total liquid product including solvent and electrolyte (1.3214 grams in size) was removed for analysis. To that sample was added 1.0 ml of an internal standard solution comprising 752 micrograms sulfur (as diphenylsufide) in n-pentadecane. The entire amount was then diluted with ~25 grams of acetone and analyzed on a Hewlett Packard gas chromatograph equipped with a Sievers sulfur chemuluminescence detector. The amounts of individual sulfur compounds as well as the total sulfur were measured. The results showed that 56.7% of the thiophene, 41.9% of the 2-methylthiophene, 50.1% of the 3-methylethiphene, 100.0% of the benzothiophene and 73.5% of the total sulfur was removed from the naphtha range by electrochemical oligomerization.

Example 7

To a 500 ml round bottom flask were added 144.92 grams of Nformylmorpholine, 5.81 grams tetra-n-butyl ammonium hexafluorophosphate ($TBAPF_6$) and 75.0 grams of a light cat naphtha having a boiling range from 170–365° F. The mixture was heated to 57° C. and circulated through the same cell configuration described in Example 1. The power to the cell was turned on and the voltage was adjusted to 6.0 V(DC) using a variable power supply. The feed was circulated through the cell for 6 hours and then the power was turned off. Average current during the run was 73.8 mA and a total of 1595 Coulombs were passed during the reaction.

A homogenized sample of total liquid product including solvent and electrolyte (3.1287 grams in size) was removed for analysis. To that sample was added 1.0 ml of an internal standard solution comprising 752 micrograms sulfur (as diphenylsufide) in n-pentadecane. The entire amount was then diluted with ~25 grams of acetone and analyzed on a Hewlett Packard gas chromatograph equipped with a Sievers sulfur chemiluminescence detector. The amounts of individual sulfur compounds as well as the total sulfur were measured. The results showed that 47.4% of the thiophene, 43.0% of the 2-methylthiophene, 44.2% of the 3-methylethiophene, 37.6% of the benzothiophene and 48.0% of the total sulfur was removed from the naphtha range by electrochemical oligomerization.

Thus in each of the preceding examples, there was a significant reduction in both total sulfur and in the concentration of several key sulfur compounds.

What is claimed is:

1. An electrochemical process for removing polymerizable sulfur compounds from a hydrocarbon feed comprising the steps of:

(a) combining a non-aqueous solvent and a non-aqueous electrolyte with a feed comprising hydrocarbon and polymerizable sulfur compounds to form a first mixture;

(b) passing said first mixture into an electrochemical reactor to electrochemically oxidize said polymerizable sulfur compounds in said mixture under conditions capable of producing sulfur oligomers from said sulfur compounds;

(c) separating said oxidized first mixture and recovering a desulfurized hydrocarbon feed, and a second mixture comprising sulfur oligomers, solvent and electrolyte.

2. The electrochemical process of claim 1 further comprising (c) recycling said second mixture to said step (a).

3. The electrochemical process of claim 1 wherein said process further comprises (d) separating said sulfur oligomers from said second mixture to recover a stream comprising solvent and electrolyte; and (e) recycling said stream comprising solvent and electrolyte to said step (a).

4. The process of claim 1 wherein said solvents are selected from the group consisting of ethylene carbonate, propylene carbonate, nitrobenzene, benzonitrile, N-formyl morpholine, sulfolane and mixtures thereof.

5. The process of claim 1 wherein said electrolytes are soluble in said organic solvent to a concentration of at least about 0.05 molar.

6. The process of claim 5 wherein said electrolytes are selected from tetraalkylammonium salts, such as tetraethylammonium perchlorate, tetrabutylammonium perchlorate, tetraethyl-ammonium tetrafluoroborate, tetrabutylammonium tetrafluoroborate, tetraethyl-ammonium hexafluorophosphate, tetrabutylammonium hexafluorophosphate, tetraethylammonium paratoluene sulfonate, tetrabutylammonium chloride, tetrabutylammonium bromide and mixtures thereof.

7. The process of claim 1 wherein said conditions capable of producing sulfur oligomers comprise potentials of about 1.0 to about 2.5 V vs. Ag/AgCl reference electrode.

8. The process of claim 1 wherein said conditions capable of producing sulfur oligomers comprise current of densities of about 1 to about 10 $A/cm^2$.

9. The process of claim 1 wherein said electrochemical reactor utilizes electrodes selected from the group consisting of platinum, stainless steel or graphite for the cathode and platinum, stainless steel, nickel or graphite for the anode.

10. The process of claim 1 wherein said first mixture is pretreated by extractive distillation to recover a hydrocarbon fraction and a bottoms fraction and said bottoms fraction is passed to said step (b) as said mixture.

11. The process of claim 1 wherein said hydrocarbon feed is an intermediate cat naphtha feed.

12. The process of claim 11 wherein said first mixture comprises a mixture of light cat naphtha and intermediate cat naphtha and said light cat naphtha is recovered as said hydrocarbon fraction.

13. The process of claim 1 wherein said polymerizable sulfur compounds are thiophene, alkylthiophenes, benzothiophene and alkylbenzothiophenes.

* * * * *